United States Patent [19]

Sendoykas

[11] 4,367,567

[45] Jan. 11, 1983

[54] DETACHABLE HINGE ASSEMBLY

[76] Inventor: Jack J. Sendoykas, 23510 Denton - Apt. 227T, Mt. Clemens, Mich. 48043

[21] Appl. No.: 263,113

[22] Filed: May 13, 1981

[51] Int. Cl.[3] ..... E05D 7/10; A47K 13/12

[52] U.S. Cl. ..... 16/263; 4/236; 16/365

[58] Field of Search ..... 4/236, 240; 16/379, 16/262, 263, 365

[56] References Cited

U.S. PATENT DOCUMENTS

| | | | |
|---|---|---|---|
| 2,240,220 | 4/1941 | Leslie | 4/236 |
| 3,038,173 | 6/1962 | Turek et al. | 4/236 |
| 3,526,907 | 9/1970 | Stairs | 4/236 |
| 3,568,223 | 3/1971 | Haldopoulos | 4/236 |
| 3,590,401 | 7/1971 | Brown | 4/236 |
| 3,608,100 | 9/1971 | Trost | 4/236 |
| 3,653,077 | 4/1972 | Warnberg | 4/236 |
| 3,802,000 | 4/1974 | Waldon | 4/236 |
| 3,820,175 | 6/1974 | Waldon | 4/236 |
| 4,133,061 | 1/1979 | Hurd | 4/236 |
| 4,159,548 | 7/1979 | Hewson | 4/236 |

FOREIGN PATENT DOCUMENTS

| | | | |
|---|---|---|---|
| 1100643 | 9/1965 | France | 4/236 |

*Primary Examiner*—Werner H. Schroeder
*Assistant Examiner*—Andrew M. Falik
*Attorney, Agent, or Firm*—Harness, Dickey & Pierce

[57] ABSTRACT

A detachable hinge assembly for a toilet, which pivotally connects a toilet seat and cover to a toilet bowl, wherein most of the hinge assembly, while remaining pivotally connected to the seat and cover, may be detached from the toilet bowl, leaving only a pair of mounting studs, which are part of the hinge assembly, attached to the toilet bowl.

3 Claims, 9 Drawing Figures

DETACHABLE HINGE ASSEMBLY

BACKGROUND OF THE INVENTION

This invention relates to the field of hinges, and more particularly to hinges for toilet seats and covers which facilitate sanitary maintenance of the seat, cover, and toilet bowl.

The problems attending the cleaning of bowls, particularly the portion of the bowl around the mounting studs and hinge pin, are well known. People have tried varied ways, and contrived many devices to reach under the seat edge and under the hinge pin for complete cleaning. With the conventional seat and cover hinge assembly, such cleaning is difficult since there is little clearance between the bottom of the hinge pin and the top of the toilet bowl.

Inventors have devised a variety of quickly detachable toilet seat hinge assemblies to overcome these cleaning problems. Most of these assemblies have one or more of the following objectionable characteristics:

Some assemblies, while permitting individual detachment of the seat and cover, leave the hinge pin fixedly attached to the mounting posts, which impedes cleaning under the hinge pin.

Some assemblies employ springs to make the hinge pin collapsible, thereby enabling detachment of the hinge pin as well as the seat and cover. However, most springs are subject to corrosion, and the cavities which house the springs may collect water, dirt, or grime.

Some assemblies employ two hinge pins, each being individually removable, thereby making the seat and cover detachable from the mounting posts or studs, which are rigidly attached to the toilet bowl. When one hinge pin is removed, the other hinge pin still in place, or its mounting post or both, can be unduly stressed or even broken by twisting forces inadvertently applied to the toilet seat or cover.

In some assemblies where the hinge pin or pins must be removed in order to detach the seat and cover, reassembly often requires careful realignment in order to reinsert the hinge pin or pins. Such assemblies are objectionable in direct proportion to the amount of undue care required for realignment and reinsertion of the hinge pins.

In some assemblies, relatively small pieces, like the hinge pins for example, are loose when the hinge pin or pins are removed because they are no longer attached to the seat or cover. Such small pieces may be accidentally dropped into the toilet bowl, misplaced, or lost, particularly when reassembly is not undertaken promptly.

Some assemblies are, relatively speaking more complex since they use a fair number of components or employ components of complex shape that are necessarily more difficult to manufacture than simpler components. Such assemblies are objectionable, when compared with simpler designs, because they are more difficult to assemble, at least initially, and are usually more expensive than simpler designs.

Some assemblies employ mounting posts or studs having recesses or cavities that are difficult to clean thoroughly, especially since their mounting studs or posts remain attached to the toilet bowl.

Some assemblies are designed to permit detachment of the seat or cover by placing a small lateral force on the seat or cover or by pulling the seat or cover away from hinge pin when the seat or cover is in a certain position. If the required force is low enough, an adult or child may accidentally uncouple the seat or cover. Also, components of such assemblies which slip or snap into position on the hinge pin may, over a period of years, loosen up or gradually wear down since they pivot about and rub against hinge pin in normal use, making the seat or cover or both more susceptible to accidental detachment.

SUMMARY OF THE INVENTION

The principal object of the present invention is to provide a hinge assembly for a toilet seat and cover that permits the detachment of the seat, cover, and most of the hinge assembly from the toilet bowl so the area of the toilet bowl around the mounting studs and the exposed portions of the mounting studs may be easily and thoroughly cleaned.

A secondary object of the invention is to provide a removable toilet seat and cover so that the same may be more easily cleaned, such as by washing in a bathtub.

A more specific object of the invention is to provide a hinge assembly wherein the seat, cover, and that portion of the hinge assembly which is detached from the toilet bowl to facilitate cleaning may remain connected together during detachment and cleaning, thus preventing misplacement or loss of individual components.

Yet another object of the invention is to provide a detachable hinge assembly for a toilet seat and cover which is extremely simple to deliberately detach and reattach.

Still another object of the invention is to provide a detachable hinge assembly which is difficult to accidentally detach.

Another object of the invention is to provide a detachable hinge assembly made of simply shaped and easily made parts.

A further object of the invention is to provide a detachable hinge assembly where it would be very unlikely to accidentally unduly stress or break any of the components during normal use, detachment or reattachment, or during playful manipulations of the seat, cover, or hinge assembly by a small child.

Other objects, features and advantages of the present invention will become apparent from the subsequent description and the appended claims taken in conjunction with the accompanying drawings.

DESCRIPTION OF THE PREFERRED EMBODIMENTS

Figure 1:
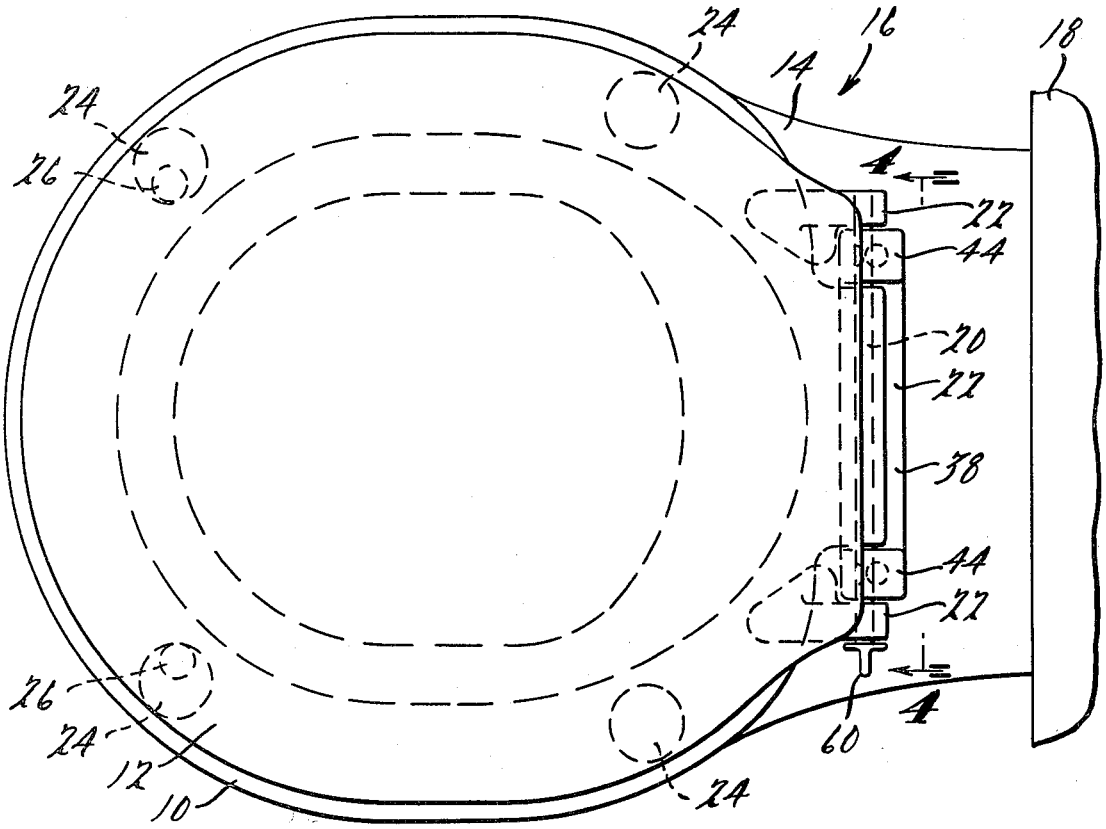
FIG. 1 is a plan view of the detachable hinge assembly with toilet seat and cover embodying the principles of the present invention, shown attached to a conventional toilet bowl.

Referring to the drawings in detail, a toilet seat 10 and a toilet seat cover 12 are shown hingedly mounted on a conventional toilet bowl 14. The bowl is part of a conventional toilet 16 which may include a water closet 18. The seat 10 and cover 12 are pivotally connected to a hinge pin 20 by conventional hinge members 22. The hinge members may be an integral part of the seat or the cover or both. In the particular form of the invention shown here by way of example, the seat 10 has an integral hinge member and the toilet seat cover 12 has a pair of spaced hinge members fastened to the underside thereof. The seat 10 has four conventional resilient spacers or pads 24 attached to the underside thereof which elevate the seat slightly above the bowl 14 to prevent the seat from rubbing directly against the bowl and to absorb shock transmitted through the seat to the bowl. The cover 12 has two conventional resilient spacers or pads 26 attached to the underside thereof which elevate the cover slightly above the seat 10 to prevent the cover from rubbing directly against the seat and to absorb shock transmitted through the cover to the seat.

Figure 2:
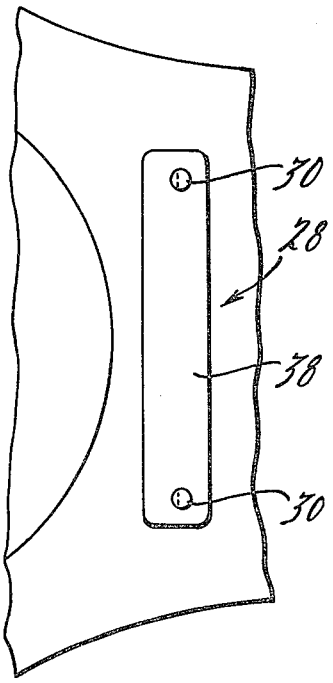
FIG. 2 is a fragmentary plan view of the mounting attached to a toilet bowl having a pair of laterally spaced upstanding studs.
Figure 3:
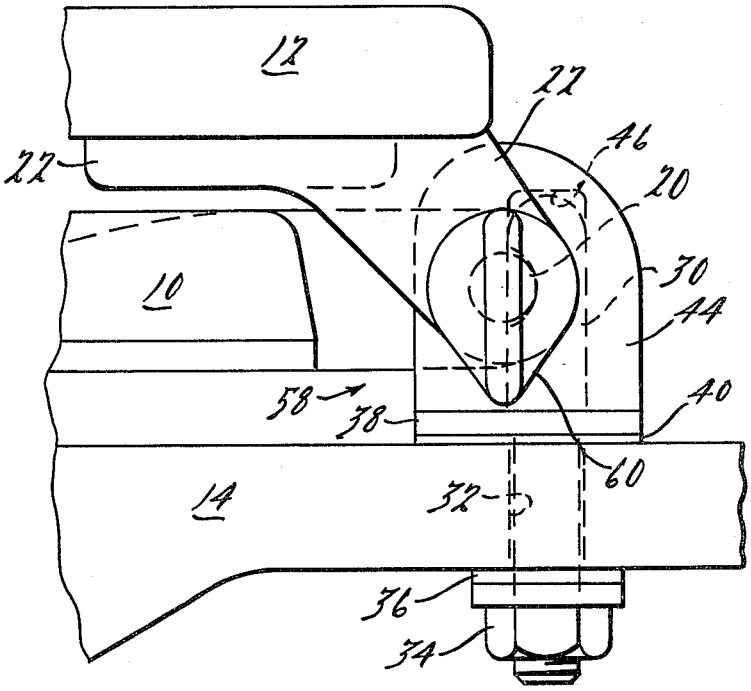
FIG. 3 is a fragmentary side elevational view showing the hinge assembly of this invention connecting a toilet seat and cover to a toilet bowl, and particularly illustrating the relationship between the mounting stud and block, and the hinge pin interlocked therewith.
Figure 5:
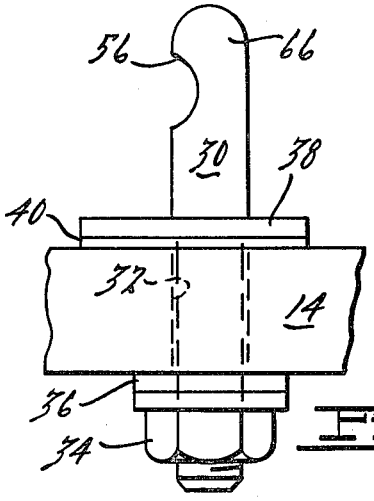
FIG. 5 is a fragmentary side elevational view of a mounting stud, showing a semi-cylindrical slot in the stud which receives and interlocks the hinge pin.
Figure 8:
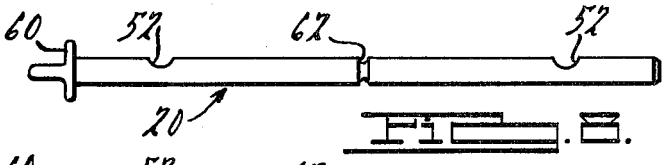
FIG. 8 is a plan view of the hinge pin in the position illustrated in FIG. 1.
Figure 9:
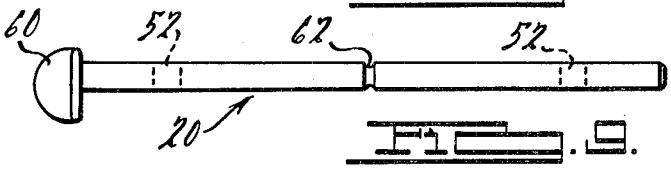
FIG. 9 is a side elevational view of the hinge pin in the position illustrated in FIG. 4.

The detachable hinge assembly is attached to the toilet bowl 14 by a mounting 28 shown in FIG. 2, which has a pair of laterally spaced upstanding studs 30. FIG. 5 shows a side elevational view of one of the studs 30. The lower portion of the studs 30 extend downwardly through a pair of holes 32 in the toilet bowl and are secured to the latter by any conventional fastening means, such as the nut 34 and the lock washer 36 shown in FIG. 5. The mounting 28 has a baseplate 38 which carries the studs 30 and prevents them from being drawn downwardly through the holes 32. A gasket 40 is located beneath the baseplate 38 to help prevent the bowl 14 from being cracked or chipped as the mounting studs 30 are tightened down and to prevent water and grime from collecting under the mounting 28.

The hinge pin 20 is rotatable and is carried by the hinge members 22 and extends through holes or openings 42 in a pair of blocks 44. The blocks 44 have sockets 46 adapted to accept the studs 30. The sockets are transverse to the openings 42 in the blocks 44 and intersect the openings 42. The sockets 46 also intersect portions 48 of the hinge pin 20 disposed in the blocks 44.

Figure 7:
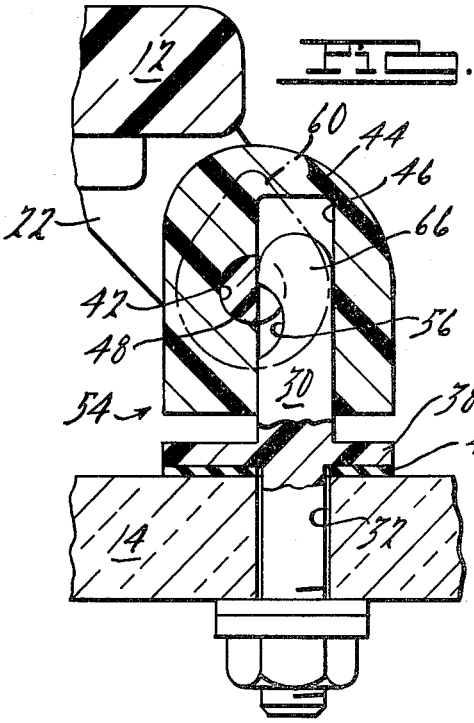
FIG. 7 is a fragmentary vertical section taken through the mounting stud, mounting block and hinge pin along line 6—6 of FIG. 4, showing the hinge pin disposed in its detachable position in the mounting block and in the process of being detached from the mounting stud.

The hinge pin 20 has transverse recesses 52, which face the sockets 46 when the blocks 44 are on the studs 30 and hinge pin is in one rotative position 54, sometimes called the first rotative position, that is shown in FIG. 7. The recesses 52 are shaped to complement the sockets 46 to permit the studs 30 to penetrate the sockets past the hinge pin 20 when the hinge pin is in the first rotative position 54.

Figure 6:
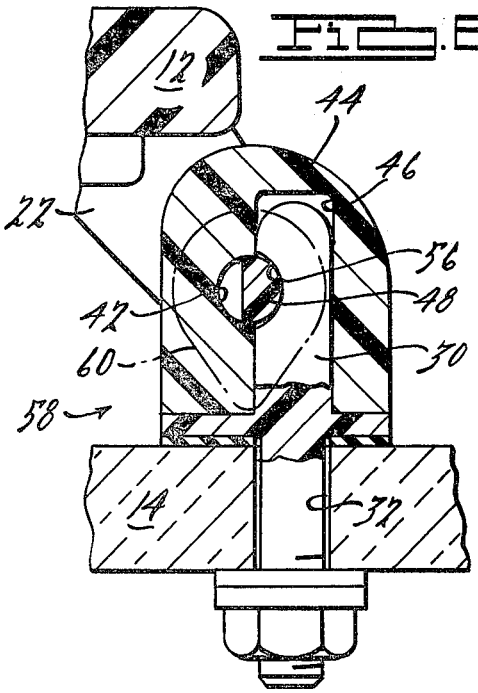
FIG. 6 is a fragmentary vertical section taken through the mounting stud, mounting block and hinge pin along line 6—6 of FIG. 4, showing the hinge pin disposed in its interlocked position in the mounting block and mounting stud.

The studs 30 have transverse slots 56 disposed to accept portions 48 of the hinge pin 20. When, as shown in FIG. 6, the studs 30 are fully inserted into the sockets 46 and the hinge pin 20 is in a second rotative position 58, wherein the recesses 52 of the hinge pin 20 face substantially away from the sockets 46, portions 48 of the hinge pin are positioned in the slots 56 of the studs 30. In this last mentioned rotative position, the hinge pin 20 is interlocked with the studs 30 thereby rigidly fastening the seat 10 and the cover 12 to the toilet bowl 14, and the studs 30 and blocks 44 are interlocked together by the hinge pin 20, forming a sturdy connection between the hinge pin and toilet bowl. Such fastening or connection is easily detached, as described below. It will be readily appreciated also that the mounting baseplate 38 normally holds the studs 30 upright and properly spaced to enter the blocks 44 as well as rotatively positioned with the transverse slots 56 disposed and aligned to accept the hinge pin 20 when the latter is turned to the locked position shown in FIG. 6.

The hinge pin 20 is disengaged from the studs 30 when the hinge pin is turned to the first rotative position 54, as shown in FIG. 7. Once the hinge pin has been so disengaged, the seat 10 may be readily removed or detached from the bowl 14, by pulling up on the seat 10, cover 12, blocks 44, or hinge pin 20. The seat, cover, blocks, and hinge pin remain pivotally connected to each other when the seat is detached from the toilet bowl.

Reattachment of the seat 10 is accomplished by placing the hinge pin 20 in its first rotative position 54, and lowering the seat 10, cover 12, blocks 44, and hinge pin 20 until the mounting studs 30 are fully inserted into the sockets 46 of the blocks, and then rotating the hinge pin to the second rotative position 58.

Figure 4:
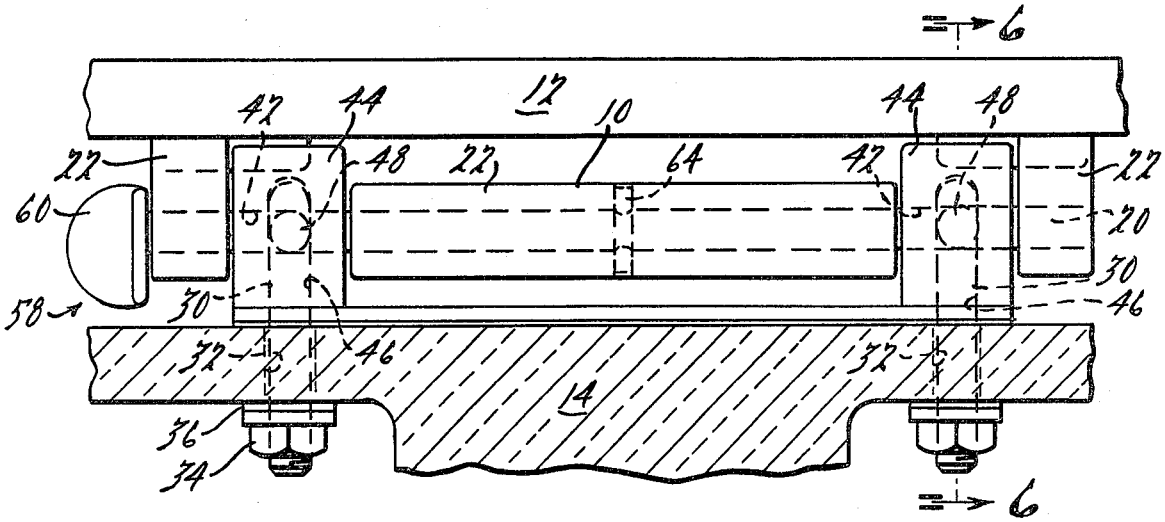
FIG. 4 is a partial vertical section taken through the rear of the toilet bowl along line 4—4 of FIG. 1.

As shown in FIG. 1 and FIG. 4, means for manually rotating the hinge pin 20 between the first rotative position 54 and the second rotative position 58 is provided by a handle 60 located on one end of the hinge pin.

The handle 60 also provides a means for indicating the rotative position of the hinge pin, since the handle is asymmetrically positioned about the axis of the hinge pin.

As shown in FIG. 4, means for restraining the hinge pin 20 against axial movement is provided by a hinge pin 20 with an annular groove 62 and a peg 64 tangentially positioned in the annular groove 62 of the hinge pin and fixedly positioned in the toilet seat 10.

In the preferred embodiment described above, the figures show that: the studs 30 have cylindrical upper portions 66; the transverse slots 56 in the studs 30 are semi-cylindrical; the blocks 44 have cylindrical sockets 46 and cylindrical openings 42; the means for rotating the hinge pin, that is, the handle 60, is permanently attached to the hinge pin 20; and the means for indicating the rotative position of the hinge pin is an integral part of the means for rotating the hinge pin.

The preferred embodiment of the invention disclosed above, as well as any variations thereof, can be made of any conventional or suitable materials using any conventional or suitable manufacturing techniques. Such materials and manufacturing techniques are well known in the field of toilet seat and hinge assembly design and manufacture and thus need not be recited here.

While it is apparent that the preferred embodiment of the invention disclosed is well calculated to fulfill the objects stated above, it will be appreciated that the invention is susceptible to modification, variation and change without departing from the proper scope or fair meaning of the subjoined claims.

I claim:

1. A quickly releasable hinge assembly for a conventional toilet seat and a conventional toilet seat cover having mounting portions provided with normally aligned pivot openings, said hinge assembly comprising:

a pair of studs adapted to be mounted in upstanding relation on and detachably fastened to a conventional toilet bowl in laterally spaced mounting holes with which such bowls are conventionally provided;

a pair of blocks adapted to interfit with the mounting portions of said toilet seat and said toilet seat cover and having pivot openings therein alignable with the pivot openings in the mounting portions of said seat and of said cover;

a single elongate hinge pin extending through and rotatable in the pivot openings of said blocks and adapted to extend into and to turn in the pivot openings in the mounting portions of both said seat and of said cover, said blocks having sockets adapted to accept said studs, said sockets being disposed transversely of and intersecting the pivot openings in said blocks and the portions of said hinge pin in said openings, the mentioned portions of said hinge pin having transverse recesses, said recesses being disposed in a first rotative position of said pin to face toward said sockets and in a second rotative position of said pin to face away from said sockets, said recesses in said first rotative position complementing said sockets to permit said studs to penetrate said sockets past said pin, and said studs having transverse slots disposed to accept the mentioned portions of said hinge pin when said studs are fully inserted into said sockets and the pin is turned to said second rotative position to face said recesses away from said sockets, and a readily accessible, manually operable handle fixed to said pin for turning the same between said first and second positions, whereby said pin is interlocked with said studs in the second rotative position of said pin to fasten said seat and said cover to said bowl in all rotative positions of said seat and said cover on said bowl, whereby said hinge pin is disengageable from said studs in the first rotative position of the pin to permit ready removal of said seat and said cover simultaneously from said bowl, and whereby both said seat and said cover can be simultaneously affixed to or removed from said bowl by a single manual manipulation of said handle from a conveniently located position with respect to said seat and said cover.

2. A quickly releasable hinge assembly as recited in claim 1, further comprising:

means integral with the manually operable handle for indicating the rotative position of said hinge pin.

3. A quickly releasable hinge assembly as recited in claim 1, wherein:

said studs have cylindrical upper portions and the transverse slots in said studs are substantially semi-cylindrical, said blocks have cylindrical sockets and cylindrical openings, said hinge pin extends through the pivot openings in the mounting portions of said seat and of said cover and projects outboard of an endmost one of said mounting portions, and said manually operable handle is fixed to the projecting portion of said hinge pin.

* * * * *